US006752240B1

(12) United States Patent
Schlagenhaft

(10) Patent No.: US 6,752,240 B1
(45) Date of Patent: Jun. 22, 2004

(54) SOUND ATTENUATOR FOR A SUPERCHARGED MARINE PROPULSION DEVICE

(75) Inventor: Daniel J. Schlagenhaft, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 10/288,190

(22) Filed: Nov. 5, 2002

(51) Int. Cl.[7] ..... G10K 11/00
(52) U.S. Cl. ..... 181/249; 247/248
(58) Field of Search ..... 181/248, 247, 181/249, 255; 417/312

(56) References Cited

U.S. PATENT DOCUMENTS

| | | | | |
|---|---|---|---|---|
| 3,993,160 A | | 11/1976 | Rauch | 181/53 |
| 4,192,401 A | | 3/1980 | Deaver et al. | 181/266 |
| 4,576,083 A | | 3/1986 | Seberger, Jr. | 89/14 |
| 5,136,923 A | | 8/1992 | Walsh, Jr. | 89/14 |
| 5,220,811 A | | 6/1993 | Harper et al. | 62/296 |
| 5,260,524 A | | 11/1993 | Schroeder et al. | 181/229 |
| 5,584,674 A | | 12/1996 | Mo | 417/312 |
| 5,605,447 A | | 2/1997 | Kim et al. | 417/312 |
| 5,679,916 A | | 10/1997 | Weichert | 89/14 |
| 5,938,411 A | | 8/1999 | Seo | 417/312 |
| 5,996,731 A | | 12/1999 | Czabala et al. | 181/229 |
| 6,129,522 A | | 10/2000 | Seo | 417/312 |
| 6,213,251 B1 | * | 4/2001 | Kesselring | 181/249 |
| 6,287,098 B1 | | 9/2001 | Ahn et al. | 418/63 |
| 6,354,398 B1 | * | 3/2002 | Angelo et al. | 181/256 |
| 6,361,290 B1 | | 3/2002 | Ide | 417/312 |
| 6,382,931 B1 | | 5/2002 | Czabala et al. | 417/312 |
| 6,405,692 B1 | | 6/2002 | Christiansen | 123/65 |
| 6,408,832 B1 | | 6/2002 | Christiansen | 123/563 |
| 6,467,572 B1 | * | 10/2002 | Liu | 181/272 |

* cited by examiner

*Primary Examiner*—Kimberly Lockett
(74) *Attorney, Agent, or Firm*—William D. Lanyi

(57) ABSTRACT

A sound attenuating system is provided which allows a relatively unobstructed airflow conduit to be associated with chambers that reflect various frequencies of sound back towards the source of the sound. The chambers are arranged in a coaxial association with the primary airflow conduit and are sized to reflect a certain range of frequencies of sound. Holes extend through the airflow conduit, in a radial direction, to place the airflow conduit in fluid communication with the chambers which surround portions of the conduit.

20 Claims, 8 Drawing Sheets

SOUND ATTENUATOR FOR A SUPERCHARGED MARINE PROPULSION DEVICE

BACKGROUND OF THE INVENTION

1. Field of the Invention

The present invention is generally related to a compact, low resistance, effective sound attenuator and, more particularly, to a sound attenuator intended for use with a marine propulsion device, such as an outboard motor and tuned for a selected range of frequencies.

2. Description of the Prior Art

Many types of devices produce sound at frequencies and amplitudes that can be annoying or discomforting to human beings in the vicinity of the device when it is operating. For example, automobile engines use mufflers to reduce the level of sound emanating from the internal combustion engine of the automobile. Many applications of compressors use mufflers, or sound dampers, to limit the magnitude of sound emanating from the compressor. When a compressor or Roots blower is used as a supercharger in conjunction with an internal combustion engine, significant sound naturally emanates from the compressor or blower. It is therefore useful to provide a sound attenuation device in combination with a compressor.

U.S. Pat. No. 4,192,401, which issued to Deaver et al on Mar. 11, 1980, describes a complete louver flow muffler. A muffler for reducing the audible noise level of exhaust gases emitted by combustion engines has an inlet tube with a patch of louvers or perforations and is arranged so that all or substantially all of the gas flowing through the muffler is forced through the patch into an expansion chamber from which it flows by either cross bleeding through a patch of louvers or perforations into an outlet tube or to a chamber opening into the inlet end of the outlet tube. A splitter partition may be used to control flow through the louvers and provide additional attenuation. An imperforate portion of the inlet tube is used as a driven tuning tube with a resonator chamber to form a Helmholtz low frequency attenuation system, the performance of which may be improved in some cases by use of an orifice in a wall of the resonator. Also disclosed is a muffler in which all of the gas flows through a louver patch in the outlet tube and an imperforate part of the outlet tube is used as a part of an aspirating type Helmholtz system.

U.S. Pat. No. 3,993,160, which issued to Rauch on Nov. 23, 1976, describes a silencer for a heat engine. An outer return tube is provided outside an exhaust silencer case and forms part of means for interconnecting the downstream end of an upstream tube and the upstream end of a downstream tube with respect to the direction of travel of the exhaust gases through the silencer. The upstream tube and downstream tube are perforated and extend in the case. At least a fraction of the exhaust gas stream travels through the outer return tube.

U.S. Pat. No. 6,408,832, which issued to Christiansen on Jun. 25, 2002, discloses an outboard motor with a charge air cooler. An outboard motor is provided with an engine having a screw compressor which provides a pressurized charge for the combustion chambers of the engine. The screw compressor has first and second screw rotors arranged to rotate about vertical axes which are parallel to the axes of crankshaft of the engine. A bypass valve regulates the flow of air through a bypass conduit extending from an outlet passage of the screw compressor to the inlet passage of the screw compressor. A charge air cooler is used in a preferred embodiment and the bypass conduit then extends between the cold side plenum of the charge air cooler and the inlet of the compressor. The charge air cooler improves the operating efficiency of the engine and avoids overheating the air as it passes through the supercharger after flowing through the bypass conduit. The bypass valve is controlled by an engine control module in order to improve power output from the engine at low engine speeds while avoiding any violations of existing limits on the power of the engine at higher engine speeds.

U.S. Pat. No. 6,405,692, which issued to Christiansen on Jun. 18, 2002, discloses an outboard motor with a screw compressor supercharger. An arrangement similar to that described above in relation to U.S. Pat. No. 6,408,832, is provided.

U.S. Pat. No. 6,382,931, which issued to Czabala et al on May 7, 2002, describes a compressor muffler. A muffler assembly for muffling noises associated with a compressor is described. The muffler assembly is mounted on the compressor such that the two move as a single body. The muffler assembly includes an intake having a hollow interior adapted to receive a first flow of gas from the ambient environment. A baffle disposed in the hollow interior of the intake restricts the flow of gas through the intake. In one embodiment, the baffle defines at least a portion of a plurality of fluid portals that separate the first flow of gas into a plurality of flows of gas as the gas passes from a first side of the baffle to a second side of the baffle. As a result, the first flow of gas is disturbed and noise from the compressor is thereby attenuated. In another embodiment, a plurality of baffles are disposed in the hollow interior of the intake to define a tortuous path for the flow of gas through the intake for attenuating noise.

U.S. Pat. No. 6,361,290, which issued to Ide on Mar. 26, 2002, describes a suction muffler for a hermetic compressor. The invention provides a suction muffler comprising component portions formed by injection forming a thermoplastic synthetic resin and joined to each other by induction welding, and also provides a hermetic compressor including the suction muffler. The suction muffler having this configuration is superior to conventional suction mufflers having joint portions joined by ultrasonic welding and vibration welding in the uniformity of the welding strength at the whole joint portion thereof and in minimizing the occurrence of fins.

U.S. Pat. No. 6,287,098, which issued to Ahn et al on Sep. 11, 2001, describes a muffler for a rotary compressor. A rotary compressor including a main bearing having a discharge passage for discharging compressed gas and a boss for inserting a motor shaft is described. The main bearing forms a component of a compression chamber and a muffler has a boss hole for passing the boss of the main bearing and a discharge opening for discharging the compressed gas. The muffler is mounted on the main bearing, wherein the discharge opening in the muffler is formed at least one in number inside of the discharge passage in the main bearing, whereby attenuating a noise generated in operation of the rotary compressor is effectively accomplished.

U.S. Pat. No. 6,129,522, which issued to Seo on Oct. 10, 2000, describes a suction muffler for a compressor. The suction muffler has a body and suction pipe. The body has an expansion chamber for expanding gaseous refrigerant flowing from an evaporator, a suction chamber for drawing the refrigerant expanded in the expansion chamber, and a resonance chamber in which the refrigerant drawn into the suction chamber resonates. The suction pipe is assembled with the body and connects the suction chamber with a cylinder head of the compressor. The suction pipe provides a passage that the refrigerant in the suction chamber flows into the cylinder head. The refrigerant flows into the suction chamber after being expanded in the expansion chamber, so the noise caused by the pulsation of pressure is reduced and the refrigerant resonating in the resonance chamber can reduce the noise of a specific frequency. Further, since the suction muffler has a simple construction having a small number of components, the leakage of noise through the gaps between the components can be reduced.

U.S. Pat. No. 5,996,731, which issued to Czabala et al on Dec. 7, 1999, describes a compressor muffler. A muffler assembly for muffling noises associated with a compressor is described. The muffler assembly includes an air intake having a hollow interior for receiving air from the ambient environment when the compressor is operating. A baffle is located within the interior of the intake for restricted passage of the air through the intake. A fluid portal is defined within the baffle for enabling fluid to pass from one side of the baffle to the other side of the baffle and subsequently through the air intake. An attenuator is disposed within the fluid portal for attenuating noise and the attenuator disturbs the sound waves associated with the operation of the compressor.

U.S. Pat. No. 5,938,411, which issued to Seo on Aug. 17, 1999, describes a compressor noise reducing muffler. A noise reducing muffler for a compressor includes a base muffler and a suction muffler connected to an upper end of the base muffler. Gaseous coolant flows through the suction muffler and the base muffler and into a cylinder head of a compressor. The suction muffler defines a path of travel wherein all of the gaseous coolant flows vertically downwardly, then horizontally, and then vertically downwardly to the base muffler.

U.S. Pat. No. 5,605,447, which issued to Kim et al on Feb. 25, 1997, describes noise reduction in a hermetic rotary compressor. The invention concerns a noise reduction method and a noise reduction device for a hermetic rotary compressor. It is designed to reduce the very high level of low frequency sound generated by the compressor by preventing the formation of reflected waves along the circumference which produce the resonant sound mode and thus by preventing the amplification of the low frequency gas pulsations. In the invention, the amplitude of the reflected waves that form the resonant sound mode is reduced by installing the muffler outlets at one half the wavelength of the reflective waves the cavity of the compressor housing from the exhaust valve where the compressed gas from the cylinder enters the muffler. By positioning these outlets face each other so that the pulsating gas components form two outlets, those at the frequency of the reflected waves formed in the circumferential direction of the cavity of the compressor housing will undergo a 180° phase shift and destructively interfere with each other.

U.S. Pat. No. 5,584,674, which issued to Mo on Dec. 17, 1996, describes a noise attenuator of a compressor. A noise attenuator for a refrigerant circulating compressor includes a casing whose interior space is divided into first the second chambers. The first chamber has an inlet for receiving refrigerant and is connected by a conduit with the second chamber. Additional conduits connect the second chamber with the compressor inlet. The cavity length L of the first chamber is determined as a function of a compressor noise to be attenuated. The first chamber may comprise a first portion and a second portion in the form of a branch line, with the cavity length L begin defined by a combination of both of the portions.

U.S. Pat. No. 5,260,524, which issued to Schroeder et al on Nov. 9, 1993, describes a muffler for an air compressor. A noise reduction method using a muffler for connection to the air inlet of an air compressor including an imperforate, hollow housing enclosed in a chamber, air inlet and outlet openings in the housing, an air inlet tube in the housing connected to the air inlet opening and an air outlet tube in the housing connected to the air outlet opening, both tubes extending over half the length of the chamber, and the openings of the distal ends of the tubes facing in the opposite directions.

U.S. Pat. No. 5,220,811, which issued to Harper et al on Jun. 22, 1993, describes a suction muffler tube. A muffler tube for use in a hermetically sealed compressor is disclosed. The muffler tube of the present invention has a roughened outer finish, and has a protuberance extending radially outwardly therefrom. The protuberance is received in a recess in the inner wall of the muffler. The combination of the roughened outer finish and the protuberance connection assist in preventing the muffler from turning on the tube and from moving vertically on the tube.

U.S. Pat. No. 5,136,923, which issued to Walsh, Jr. on Aug. 11, 1992, describes a firearm silencer and flash attenuator. A firearm sound suppressor includes an outer housing, an interior perforated tube located within the outer housing, and spacing between the outer housing and interior perforated tube. The sound suppressor is adapted to be mounted on a firearm.

U.S. Pat. No. 5,679,916, which issued to Weichert on Oct. 21, 1997, describes a gun silencer. A silencer for a firearm is disclosed as comprising a composite outer wall, an end piece which forms a silencer muzzle and in which is located an exit opening, an attachment piece which is attached to the end piece, and a middle piece which is positioned between the attachment piece and the end piece. The middle piece comprises a selected number of successive chambers which are aligned with each other. Each of the chambers has a firing opening and an outside wall. Each of the chambers is attached in a modular fashion directly to an adjoining one of the selected number of chambers. The outside walls of the selected number of chambers form the composite silencer wall. The number of silencers is selected in accordance with the intended use of the silencer.

U.S. Pat. No. 4,576,083, which issued to Seberger, Jr. on Mar. 18, 1986, describes a device for silencing firearms. A cylindrical silencer tube is fastened to a muzzle of a firearm. The interior of the tube is equipped with a series of chambers and conically shaped baffles which direct part of the discharge gases and sound waves in a different path from the main discharge and then causes them to reunite before they discharge the silencer at a point where part of the sound waves have been delayed and are hence out of phase with the principal waves and cause elimination of the noise. Specially constructed inlet and outlet chambers within the tube aid in the suppression of the sound waves and deafening of the noise. The exterior of the cylindrical silencer tube is equipped with a series of cooling fins to aid in the dissipation of heat from the silencer.

The patents described above are hereby expressly incorporated by reference in the description of the present invention.

In certain applications, it is critically important that the sound attenuating device be compact and require a minimum amount of space. It is also very important in certain applications that the sound attenuating device be as minimally restrictive to air flow as possible. These characteristics are particularly important in applications such as marine propulsion devices, where the sound attenuator device must be contained within a restricted space, such as under the cowl of an outboard motor. Also, in an outboard motor application, it is important that the sound attenuating device not inhibit the free flow of air into the compressor.

It would therefore be significantly beneficial if a sound attenuating device could be provided which requires minimal space and which provides very little resistance to the free flow of air through the device as it passes to a compressor and, eventually, to the intake manifold of an internal combustion engine.

SUMMARY OF THE INVENTION

A sound attenuator for a supercharged marine propulsion device, made in accordance with the preferred embodiment of the present invention, comprises an airflow conduit having an inlet end and an outlet end. In certain applications, the outlet end is connectable in fluid communication with an inlet conduit of a compressor. A first chamber is disposed proximate a first portion of the airflow conduit. The first chamber has a first length. A first plurality of holes is formed through the first portion of the airflow conduit, with the first plurality of holes being in fluid communication between the airflow conduit and the first chamber. The first length and the size of each of the first plurality of holes are selected to be compatible with each other in reflecting a first range of frequencies of sound, which are passing in a direction from the outlet end toward the inlet end of the airflow conduit, back toward the outlet end of the airflow conduit. A second chamber is disposed proximate a second portion of the airflow conduit and has a second length. A second plurality of holes if formed through the second portion of the airflow conduit, with the second plurality of holes being in fluid communication with the airflow conduit and the second chamber. The second length and the size of each of the second plurality of holes are selected to be compatible with each other in reflecting a second range of frequencies of sound, which are passing in a direction from the outlet end toward the inlet end of the airflow conduit, back toward the outlet end of the airflow conduit.

The compressor has the inlet conduit and an outlet conduit and an associated internal combustion engine has an air intake conduit. The outlet conduit of the compressor is connected in fluid communication with the intake conduit of the internal combustion engine.

The first and second chambers, define first and second annular cavities surrounding the first and second portions of the airflow conduit, respectively. The first and second annular cavities are generally coaxial with the first and second airflow conduits, respectively. The first and second plurality of holes extend radially through the first and second portions of the airflow conduit, respectively.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
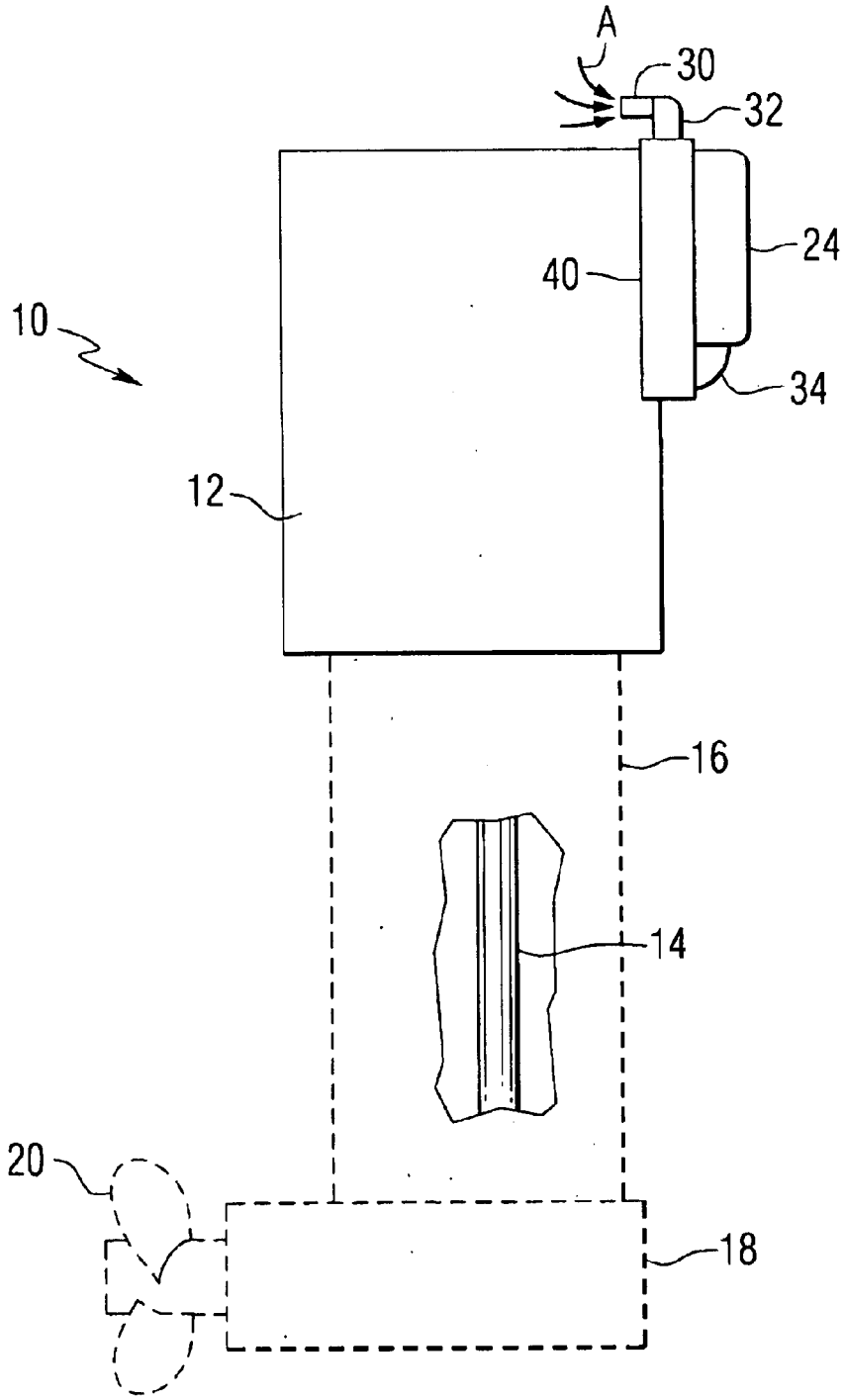
FIG. 1 is a highly schematic representation of an outboard motor.

Throughout the description of the preferred embodiment of the present invention, like components will be identified by like reference numerals.

FIG. 1 is a highly simplified representation of an outboard motor 10. The purpose of FIG. 1 is to schematically illustrate the environment in which the present invention is primarily intended for use. However, it should be understood that alternative applications of the sound attenuating system of the present invention are also within its scope. The outboard motor 10 comprises an internal combustion engine 12 which, in turn, comprises an internally supported crankshaft as is well known to those skilled in the art. The crankshaft is supported within the internal combustion engine 12. The crankshaft is connected in torque transmitting relation with a driveshaft 14 that is supported within a driveshaft housing 16. The driveshaft 14 is connected in torque transmitting relation with a propeller shaft (not shown in FIG. 1) that is supported for horizontal rotation within a gearcase 18. A propeller 20 is attached to the propeller shaft for rotation.

With continued reference to FIG. 1, the internal combustion engine 12 is provided with a compressor 24 that provides a compressed air charge for the internal combustion engine. The compressor 24 acts as a supercharger for the engine. In a particular example of an application of the present invention, the compressor 24, or supercharger, can be a screw compressor. In operation, air is drawn into an inlet end 30 of an airflow conduit 32. The airflow conduit also has an outlet end 34. As will be described in greater detail below, a plurality of chambers are formed in an outer housing 40 which is disposed around the airflow conduit 32.

Figure 2:
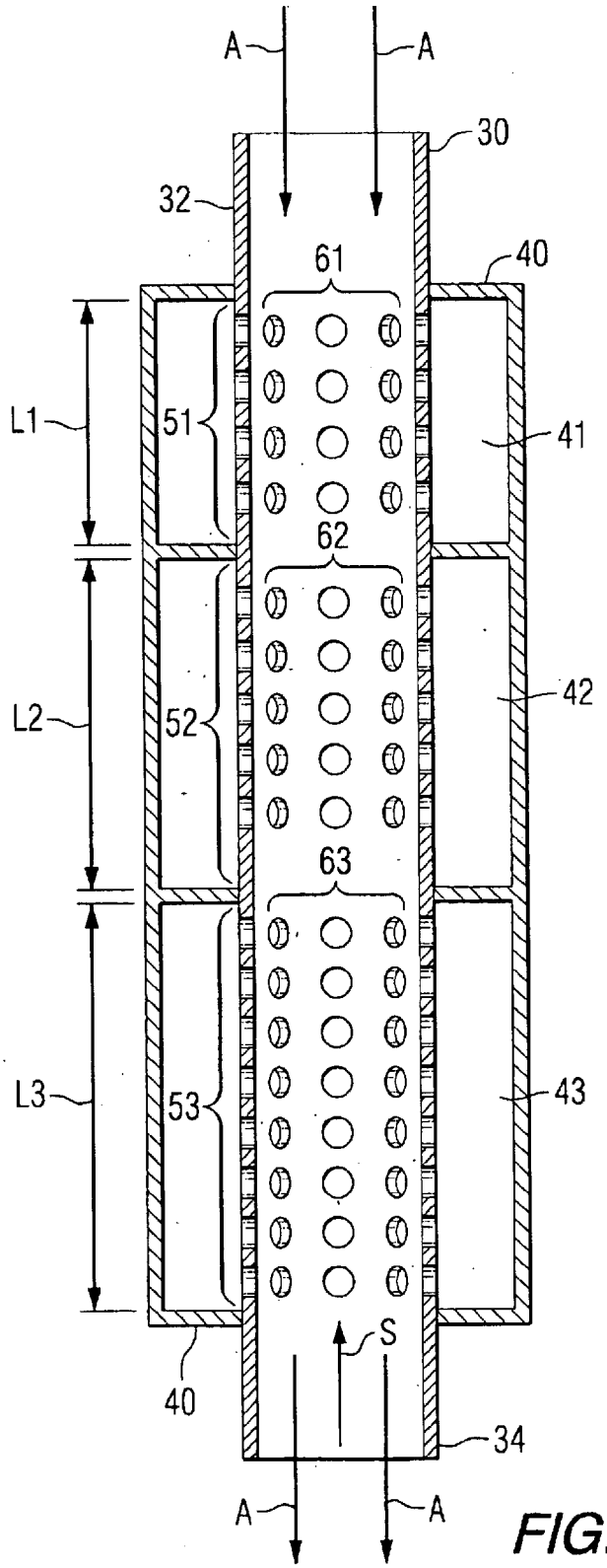
FIG. 2 is a section view of a simplified representation of a basic application of the present invention.

FIG. 2 is a more detailed schematic representation of the present invention.

In FIG. 2, three chambers, 41–43, are illustrated. The first chamber 41 is disposed proximate a first portion 51 of the airflow conduit 32 and has a first length L1. A second chamber 42 is disposed proximate a second portion 52 of the airflow conduit 32 and has a second length L2. A third chamber 43 is disposed proximate a third portion 53 of the airflow conduit 32 and has a third length L3.

With continued reference to FIG. 2, a first plurality of holes 61 are formed through the wall of the first portion 51 of the airflow conduit 32 and are in fluid communication between the airflow conduit 32 and the first chamber 41. Similarly, the second and third plurality of holes, 62 and 63, are formed through the walls of the second and third portions, 52 and 53, of the airflow conduit 32 and are disposed in fluid communication between the airflow conduit 32 and the second and third chambers, 42 and 43, respectively. In each case, the length (e.g. L1, L2, and L3) and the size of each of the respective plurality of holes (e.g. 61, 62, and 63) are selected to be compatible with each other in reflecting a particular range of frequencies of sound, which are passing through the airflow conduit 32, back toward the source of that range of frequencies of sound. In other words, length L1is selected to be compatible with the size of each of the first plurality of holes 61 in reflecting a first range of frequencies of sound back toward the source of that range of frequencies, and so forth.

In a particular application of the present invention, the outlet end 34 of the airflow conduit 32 is connectable in fluid communication with an inlet conduit of a compressor. The compressor inherently produces sound of various different frequencies. Some of these frequencies result in a particular level of discomfort and annoyance for people in the vicinity of the compressor. More particularly, although the air flows through the airflow conduit 32 in the direction represented by arrows A, the sound emanates from the compressor, or blower, in a direction represented by arrow S and, if unabated, travels from the outlet end 34 of the airflow conduit 32 toward the inlet end 30. As described above in conjunction with FIG. 1, the inlet end 30 can be an open end of the conduit intended for receiving a flow of air from the surrounding area, as represented by arrows A. This would normally allow the sound to emanate from the inlet end 30 and possibly become a nuisance and a discomfort for people in the vicinity of the inlet end 30.

Each of the chambers, 41–43, is sized to reflect a preselected range of frequencies of sound back toward the source of the sound which, in the exemplary case described immediately above, is in a direction back toward the outlet end 34 of the airflow conduit. In a preferred embodiment of the present invention, each of the chambers, 41–43, operates relatively independently from the others and are each tuned, through a selection of the magnitude of their lengths, L1–L3, and the sizes of their respective plurality of holes, 61–63, to reflect a particular range of frequencies of sound back toward the source which is in a direction opposite to arrow S in FIG. 2.

Figure 3:
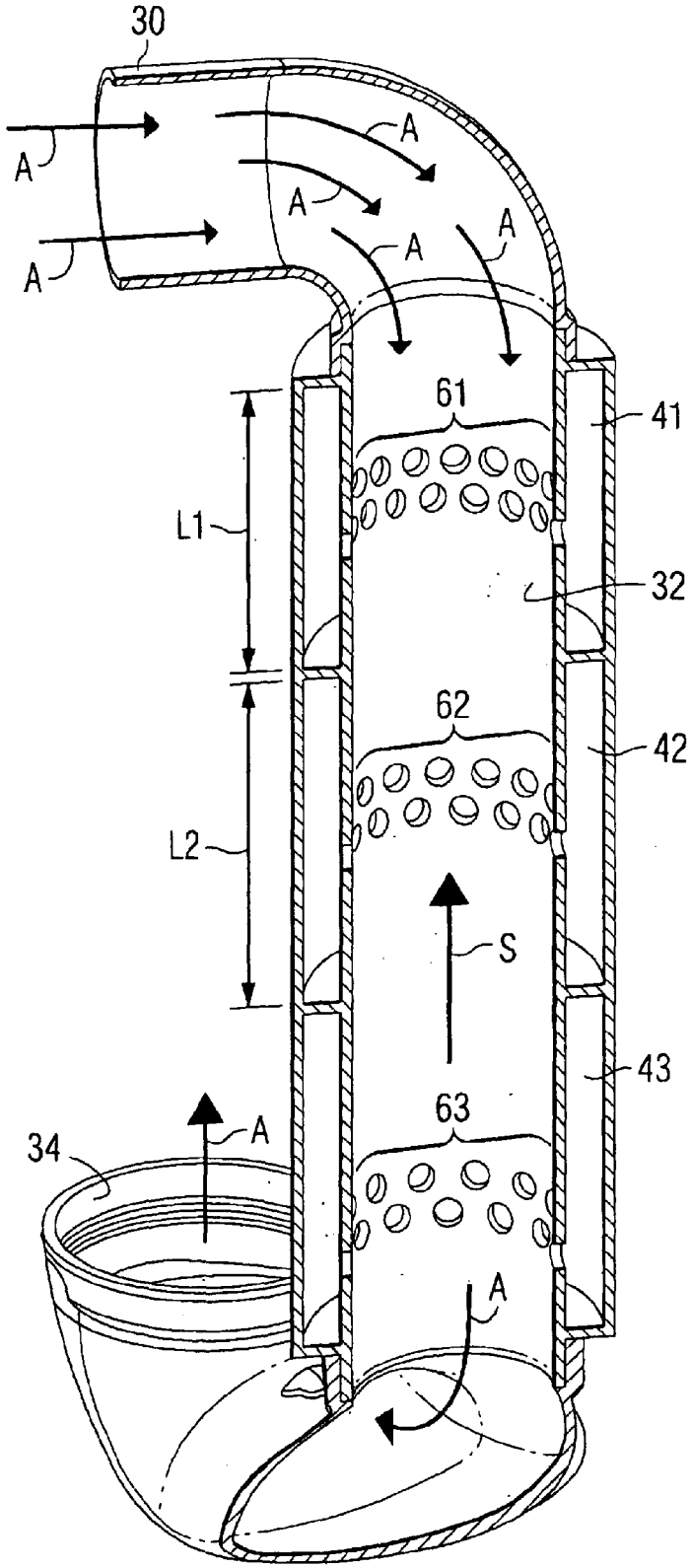
FIG. 3 is a section view of an airflow conduit and sound attenuator made in accordance with the present invention.

FIG. 3 is a section view of an airflow conduit made in accordance with the present invention and intended for a specific use in conjunction with a screw compressor 24, or supercharger, in a manner generally similar to that described above in conjunction with FIG. 1. The inlet end 30 is an open end into which air is induced to flow because of the reduced pressure within the airflow conduit 32 caused by the operation of a screw compressor connected to the outlet end 34 of the airflow conduit 32. After flowing into the inlet end 30, the air proceeds downwardly through the airflow conduit 32 and through the first 51, second 52, and third 53 portions of the airflow conduit 32. In doing so, it flows past the first 61, second 62, and third 63 plurality of holes formed through the respective portions of the airflow conduit. After flowing out of the third portion 53 of the airflow conduit, the air is turned through a bend in the structure shown in FIG. 3 to flow upwardly into a screw compressor, which will be described in greater detail below. Sound which emanates from the screw compressor moves in a direction from the screw compressor into the outlet end 34 of the airflow conduit 32. It then would normally pass upwardly through the airflow conduit 32 in a direction generally opposite to arrows A which represent the direction of air flow through the airflow conduit 32. Each of the chambers, 41–43, are sized to cause specific frequencies of sound to be reflected backwardly toward the screw compressor and in a generally downward direction in FIG. 3 within the first, second, and third portions of the airflow conduit 32. The sizes of the chambers, in cooperation with the first, second, and third pluralities of holes, 61–63, create a compatible combination which causes the sound to be reflected in this manner. In a particularly preferred embodiment of the present invention, each of the three chambers, 41–43, is individually sized to affect a particular range of frequencies of sound in this way. The sizes of each of the pluralities of holes, 61–63, are selected to cooperate advantageously with the lengths, L1–L3, of the chambers, 41–43, respectively. When the three chambers are individually sized to cause the reflection of different ranges of sound, the combination of the three chambers is highly effective in reducing the emanated sound from the inlet end 30 over a wider range of frequencies.

Figure 4:
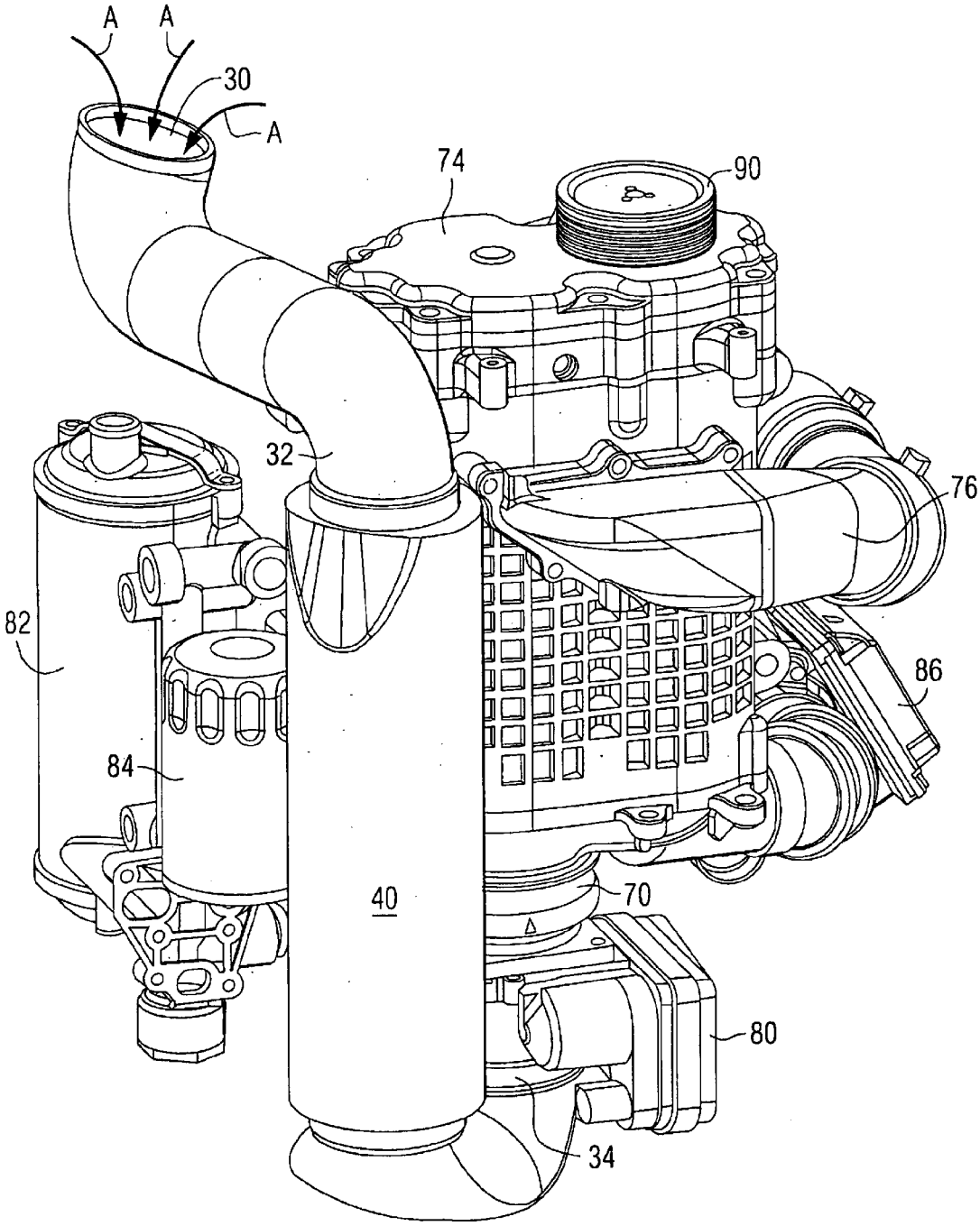
FIG. 4 shows the sound attenuator of FIG. 3 associated with a screw compressor.

FIG. 4 shows the present invention connected to an inlet end 70 of a screw compressor 74. After the air, represented by arrows A, is drawn into the inlet end 30 of the airflow conduit 32, it passes downwardly through the first, second, and third portions of the airflow conduit to the outlet end 34. The outlet end 34 is connected in fluid communication with an inlet conduit 70 of the compressor 74. In FIG. 4, the compressor 74, or supercharger, is a screw compressor that comprises two internal screws that are supported for rotation about vertical axes. The screw compressor 74 has an outlet conduit 76 which directs compressed air to the air intake conduit of an internal combustion engine 12. In this way, the compressor 74 acts as a supercharger for the internal combustion engine 12. Also shown in FIG. 4 is an electronic throttle control device 80, an oil cooler 82, an oil filter 84, and an electronic bypass control device 86. A rotatable pulley 90 is provided to allow the compressor 74 to be driven by a belt that is associated with the pulley 90 and a pulley on the engine 12.

With continued reference to FIG. 4, air is drawn into the inlet end 30 of the airflow conduit 32 and flows downwardly through the first, second, and third portions of the airflow conduit toward the outlet end 34. The flow of air is then turned upwardly as it flows out of the outlet end 34 and into the inlet conduit 70 of the compressor 74. The air is compressed by the compressor 74 and flows out of the outlet conduit 76 of the compressor 74. From the outlet conduit 76, compressed air flows toward the intake manifold of the engine 12. As described above in conjunction with the United States patents that describe supercharged engines which are known to those skilled in the art, the compressor 74 can be provided with a bypass conduit to allow the flow of air to the engine to be regulated and a charge air cooler to reduce the temperature of the compressed air.

As described above, the present invention is intended to act as a noise attenuating device associated with the intake port of a compressor. It is also intended to attenuate sound over a relatively large range of frequencies. Two important requirements exist in relation to a sound attenuator used in conjunction with a compressor that is being used as a supercharger for an outboard motor engine. First, the size of the sound attenuator is significantly limited because of its required location under the cowl of the outboard motor. In addition, the sound attenuator must not overly obstruct the air passageway through which the air compressor receives air that is compressed and subsequently conducted into the internal combustion engine.

Two general principles are well known to those skilled in the art in relation to obtaining a filtering or sound attenuating function. These general principles include absorption and reflection. In a sound attenuator that operates under the absorption principle, the transmission of sound energy is reduced by absorbing a large part of the incident energy within the duct through which air flows. Sound absorptive structures sometimes meet practical difficulties in applications within ducts where the temperature or velocity of the duct is very high. In sound attenuators that use the reflection principle, discontinuities are provided so that when a sound wave traveling through a duct arrives at the discontinuity, where the acoustical impedance is either much higher or much lower than the characteristic impedance of the duct, only a small fraction of the acoustical energy can flow through the discontinuity. The rest of the energy goes into a reflected wave that originates at the discontinuity and travels back toward the source. As a result, the transmission of sound energy can be reduced by inserting appropriate discontinuities in the duct, even though these discontinuities may not actually absorb any of the energy. Typically, reflective acoustical filters are most effective at low frequencies in contrast to sound absorptive structures which are usually most effective at high frequencies.

One approach to the reduction of engine exhaust noise, which is known to those skilled in the art, is the use of silencer systems with expansion chambers and resonators. These silencer elements operate on the reactive principle, reflecting the engine generated pressure waves back to the source while transmitting only a part of the fluctuating energy toward the tailpipe. A silencer used in conjunction with an exhaust system of an engine in contradistinction to the preferred embodiment of the present invention described above, typically experiences the airflow (e.g. The exhaust gases) moving in the same direction as the sound generated by the engine. In a preferred application of the present invention, the sound is generated by the compressor which is downstream from the sound attenuator of the present invention. Therefore, the sound generated by the compressor travels in a direction that is opposite to that of the airflow.

Those skilled in the art are familiar with sound attenuators that are known as concentric tube resonators. These resonators generally comprise a concentric tube configuration in which the outer tube forms a jacket around the center or air passage tube. The annular space between the two tubes forms the cavity of the resonator and communication is provided by perforating the central tube, usually along its entire length, with a large number of small holes or louvers. A resonator of this type obeys the basic physical principles in which the inertia of the oscillating mass of gas in each hole or neck works against the combined equivalent spring and mass of the entrapped volume of gas in the cavity.

The beneficial effects of the present invention result from the combination of a plurality of sound attenuating regions, each of which is tuned to attenuate a particular frequency range, that are combined together to attenuate a much wider range of frequencies. The attenuation provided by each of the chambers, 41–43, behaves according to equations 1–4 shown below. With reference to FIGS. 2 and 3 and equations 1–4, "n" describes the number of holes in any particular plurality of holes, 61–63. The wall thickness of the airflow conduit 32 is represented by "1". Each of the holes of any particular plurality of holes is represented by "$S_0$" in the equations. The cross sectional area of the airflow conduit 32 is represented by "$S_1$" and the annular cross sectional area of the surrounding chamber is represented by "$S_2$". The length (e.g. L1–L3) of the particular chamber is represented by "$1_2$". The attenuation, as described in equation 1 below, is calculated for each of the chambers, 41–43. The size of the holes in each plurality of holes, 61–63, is determined in combination with the volume of its associated chamber, 41–43, and the length, L1–L3, of that particular chamber. Each of the sound attenuating portions, including the dimensions of the chamber and the dimensions of the associated plurality of holes, is particularly tuned to attenuate a preselected frequency range. Each of the chambers is tuned to attenuate a slightly different frequency range than the other sound attenuating chambers. As a result, the plurality of chambers, 41–43, and their associated holes, combine to attenuate a relatively wide range of frequencies that are associated with a screw compressor.

$$\text{Attenuation} = 10\ \text{Log}_{10}\left[1 + \frac{1}{4}\left(\frac{m}{\frac{kS_2}{c_o} - \cot(kl_2)}\right)^2\right](\text{dB}) \tag{1}$$

$$k = \frac{2\pi f}{c} \tag{2}$$

$$c_o = \frac{nS_0}{l + 0.8\sqrt{S_0}} \tag{3}$$

$$m = \frac{S_2}{S_1} \tag{4}$$

In the above equations, $\pi$=3.14159, cot is the inverse tangent trigonometric function (i.e. cotangent), k is the wave number, f is the frequency of sound, c is the speed of sound, $c_0$ is the conductivity, n is the number of holes, l is the inner tube wall thickness, $S_0$ is the circular area of single hole, $S_1$ is the circular cross sectional area of inner tube, $S_2$ is the circular cross sectional area of annular volume, m is the area expansion ratio, and $l_2$ is the length of annular volume.

In operation, sound is generated by the compressor and travels in a direction represented by arrow S in FIG. 3. As the sound waves pass the third plurality of holes 63 and the associated chamber 43, a preselected range of frequencies, for which the attenuating portion 53 is tuned, is reflected back toward the outlet end 34. Remaining frequencies of sound, for which the third chamber 43 and third plurality of holes 63 are not specifically tuned, continue to travel upward through the airflow conduit 32. As the sound passes the second plurality of holes 62 and its associated second chamber 42, a different frequency range is reflected back toward the outlet end 34. When the sound passes upwardly through the first portion 52 of the airflow conduit 32, the first plurality of holes 61, in combination with the first chamber 41, cause another range of frequencies to be reflected back toward the outlet end 34. Therefore, as the sound travels in the direction represented by arrow S in FIG. 3, each portion of the present invention sequentially reflects a frequency range for which it is tuned. By combining a plurality of tuned portions of the attenuator, a relatively wide range of frequencies can be reflected back toward the compressor which is connected to the outlet end 34 of the airflow conduit 32.

Concentric tube resonators are known to those skilled in the art. The combination of a chamber, with a plurality of holes associated with the chamber and the airflow conduit, is also known to those skilled in the art. The present invention builds on that known technology to combine a plurality of chambers and holes which are each individually tuned to a preselected range of frequencies in order to attenuate a relatively wide range of frequencies associated with an air compressor that is used as a supercharger. The present invention also combines the individual sound attenuating elements into an airflow conduit that directs incoming air from ambient surroundings to the inlet of the compressor. Because of its association with an inlet of a screw compressor, the sound emanating from the screw compressor originates in a direction that is opposite to that of the airflow. The sound attenuating elements of the present invention therefore cause the sound to be reflected in a direction that coincides with the direction of airflow toward the compressor.

Figure 5:
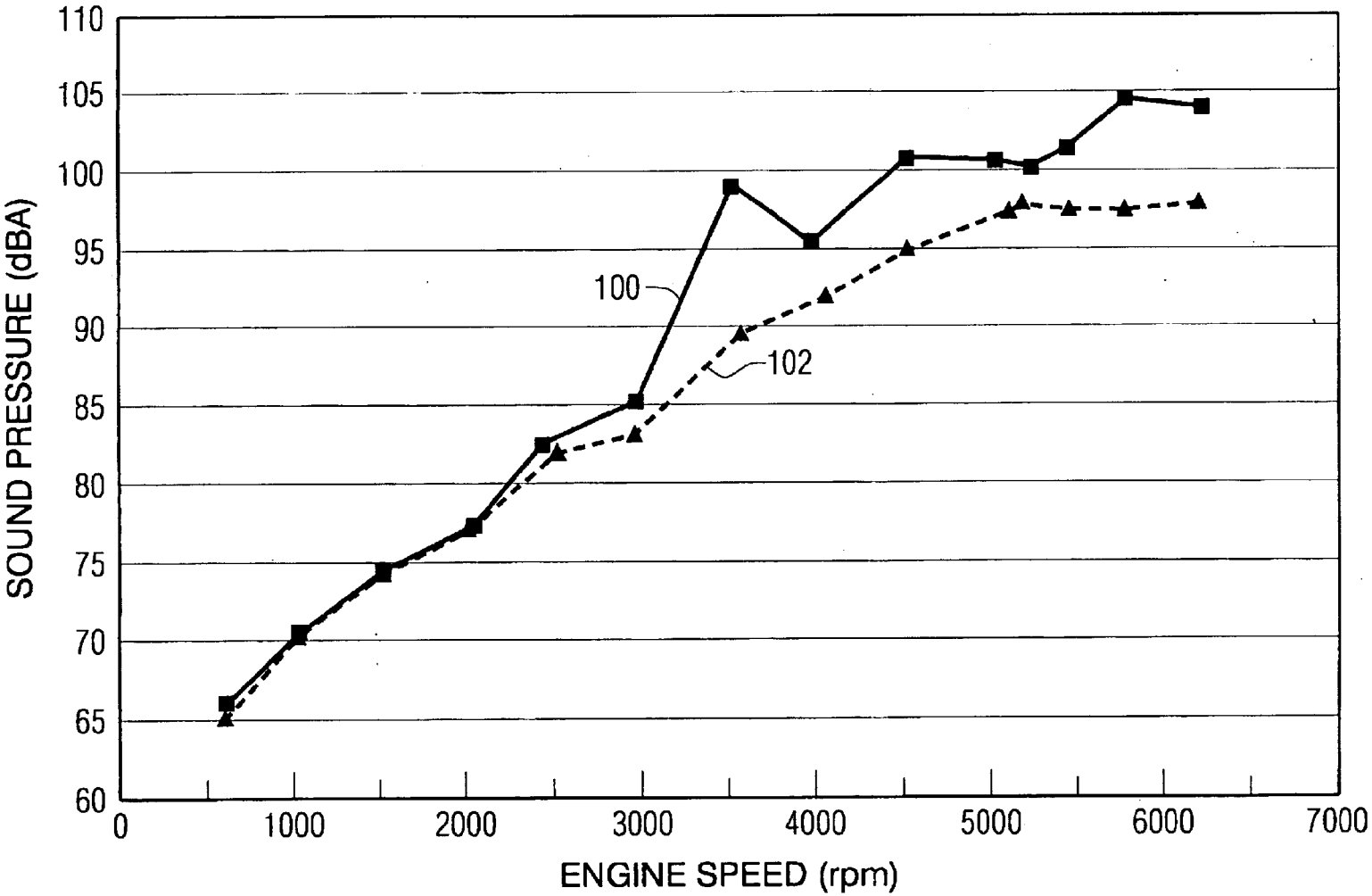
FIG. 5 is a graphical representation of the overall effect on total sound pressure through the use of the present invention.

FIG. 5 is a graphical representation of the improvement that is possible through the use of the present invention in conjunction with a supercharged outboard motor. In FIG. 5, line 100 represents the total sound pressure emanating from an outboard motor (with the cowl removed) equipped with a supercharging screw compressor 74, but without the sound attenuating system of the present invention. Line 102 represents the same outboard motor(with the cowl removed) and supercharging compressor 74, but with the present invention connected in serial fluid communication with the inlet conduit 70 of the screw compressor 74. It can be seen, particularly for engine speeds above 3000 RPM, a significant decrease in the sound emanating from the compressor 74 is realized. It should be understood that the information graphically represented in FIG. 5 represents the total sound pressure and is not limited to any particular frequency or range of frequencies.

Figure 6:
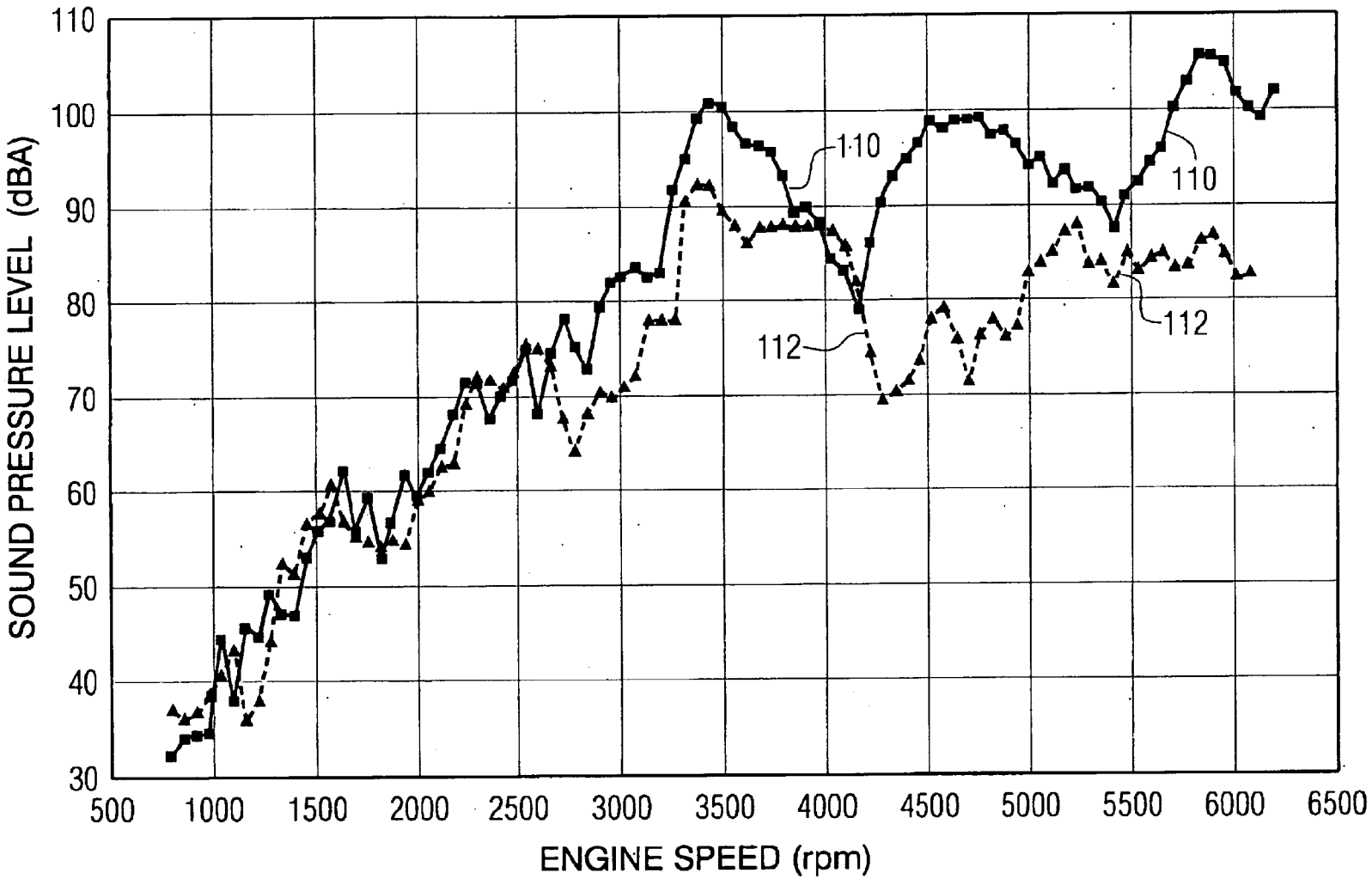
FIG. 6 shows the effect of the present invention on a first harmonic of compressor sound at various engines speeds.

FIG. 6 is a graphical representation of the sound pressure resulting from the primary operating frequency of the screw compressor 74 which was described above in conjunction with FIG. 4. As can be seen, for most engine speeds above approximately 2700 RPM, the line 110, which represents the noise emissions without the present invention connected to the inlet conduit 70 of the compressor 74, is higher than line 12, which represents the same arrangement, but with the present invention connected to the inlet conduit 70 of the compressor 74. While the difference between lines 110 and 112 at engine speeds above 2700 vary somewhat, it can be seen that the predominant effect of the use of the present invention is to provide a significant reduction in the sound pressure level at most of the engine speeds above 2700 RPM.

Figure 7:
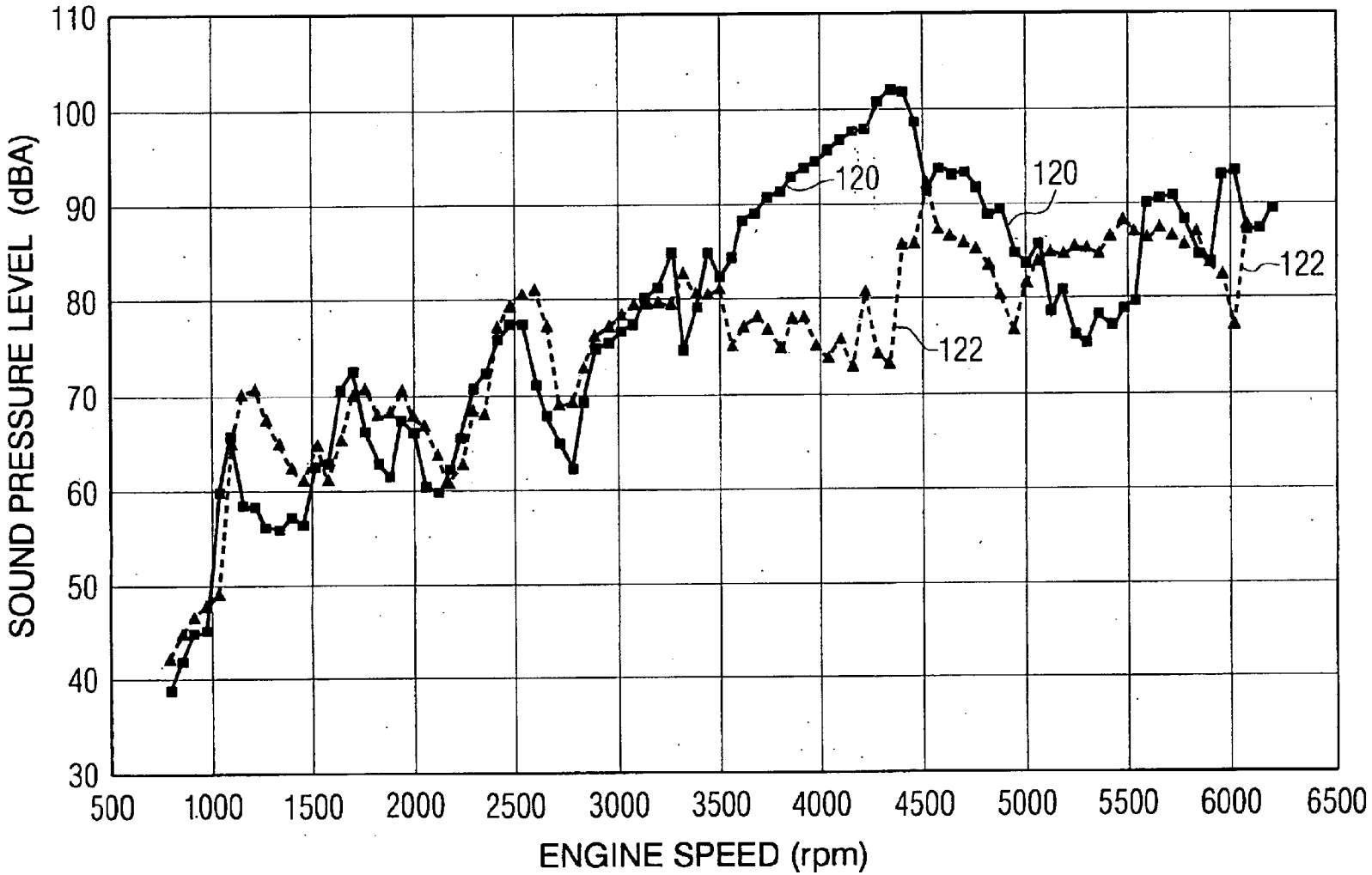
FIG. 7 shows the effect of the present invention on a second harmonic at various engine speeds.

FIG. 7 is a graphical representation of sound pressure resulting from the secondary operating frequency of the supercharger 74. Above an engine speed of approximately 3500 RPM, the line 120 which represents the operation of the supercharger 74 without the present invention, is higher than line 122 which represents the operation of the supercharger with the present invention connected to its inlet conduit 70.

With respect to FIGS. 6 and 7, it should be understood that the primary and secondary frequencies of sound emanating from the compressor vary directly in conjunction with the engine speed since the compressor is driven directly by the engine crankshaft through a belt end pulley arrangement. As a result, the primary and secondary frequencies of sound emanating from the compressor naturally increase as the engine speed increases. Therefore, the beneficial effect of the present invention, which is tuned to particular ranges of frequencies of sound, become more apparent at engine speeds that result in the preselected frequency ranges for which the present invention is tuned to attenuate.

Figure 8:
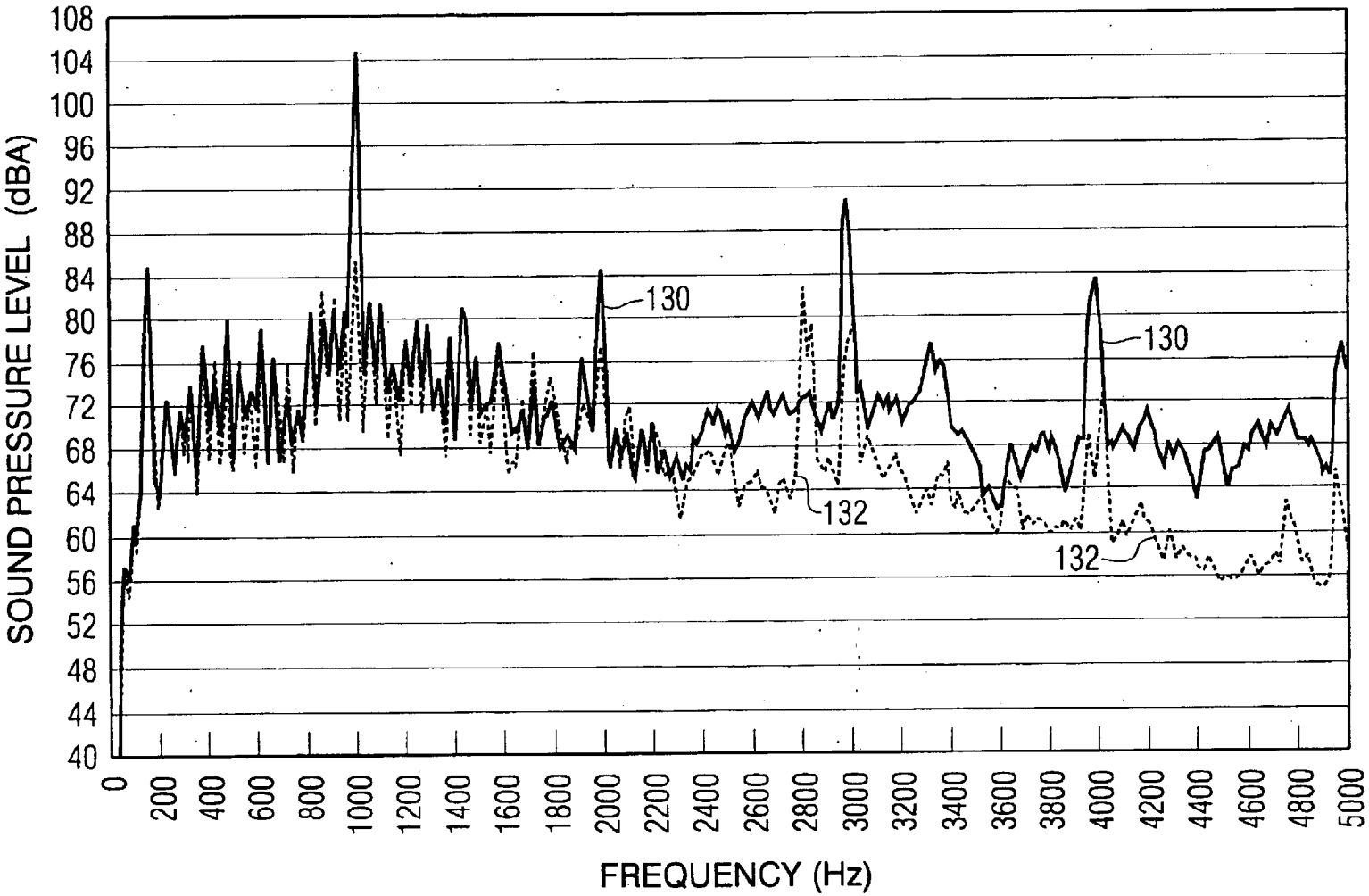
FIG. 8 shows the effect of the present invention at a wide range of frequencies.

FIG. 8 is a graphical representation of the sound pressure level at various frequencies of sound for a screw compressor 74 without the present invention connected to it, represented by line 130, and a supercharger 74 with the present invention connected to its inlet conduit 70, as represented by line 132. As illustrated in FIG. 8, the sound pressure level at frequencies above approximately 2400 Hertz are reduced in comparison to the operation of the screw compressor without the present invention connected. Although it can also be seen that the beneficial effects of the present invention are realized over a wide range of frequencies, including that in the range above 2400 Hertz, a particularly beneficial effect of the present invention can be seen in the significant reduction of the sound level peak at approximately 1,000 Hertz, as shown in FIG. 8. This advantage is obtained by providing a plurality of chambers, 51–53, which are each tuned to reflect a particular range of frequencies of sound back toward the supercharging compressor 74.

For any particular chamber and any particular size of holes, a resulting range of frequencies of sound can be caused to be at least partially reflected back toward the source of that sound which, in this particular case, is a screw compressor. If each of the chambers and their associated hole diameters are selected to reflect different ranges of frequencies of sound, the use of a plurality of chambers can be advantageously combined to reflect a wider range of frequencies of sound back toward the origin of that sound.

With reference to FIGS. 1–8, it should be understood that certain applications of sound attenuating devices are significantly limited because of the circumstances of those particular uses. For example, some sound attenuating devices can afford to incorporate numerous baffles within their structure to create a tortuous path for the airflow in order to enhance the sound attenuating characteristics of the device. However, when airflow is critical to the operation of a device or system, a tortuous flow path significantly increases the resistance airflow and disadvantageously affects the operation of the device. In these types of applications, it is therefore very important that an unobstructed, or virtually unobstructed, flow path be provided so that this resistance to airflow is minimized. As an example, the air intake path of an engine must remain relatively unobstructed in order to allow the engine to operate efficiently. If the air path is obstructed, the overall size of the sound attenuating device must be increased in order to allow the required air charge to be supplied to the engine.

In certain applications of sound attenuators, the available area in which the attenuating device is disposed is severely limited. If space is not limited, large sound attenuating devices can be used without adverse consequences. However, a sound attenuator used in conjunction with an engine of an outboard motor is severely restricted in available space because the engine is disposed under a cowl of the outboard motor along with many other accessory pieces of equipment. Very little available volume under the cowl is unused. Therefore the space available for a sound attenuator is severely limited.

The restrictions of unobstructed airflow and minimal available space make the use of many known types of sound attenuators impossible or very difficult. Most sound attenuators that operate under the principle of canceling sound waves with reflected sound waves require too much volume to be usable in conjunction with an outboard motor.

The present invention minimizes the total volume necessary to provide the sound attenuation for a screw compressor supercharger. It advantageously packages the required elements of the sound attenuator in a way that minimizes the necessary space used to contain the attenuator. In addition, it maintains a clear air passageway without obstruction extending into the passageway. The absence of baffles and other obstructions within the airflow conduit avoids the disadvantageous interference with the airflow that would otherwise adversely affect the operation of the engine. The sound attenuating system of the present invention is provided with an outlet end 34 that is connectable in fluid communication with an inlet end 70 of a compressor 74 (similar to compressor 24 in FIG. 1). The compressor has an outlet conduit 76. The chambers, 41–43, of the present invention define first, second, and third annular cavities which surround their respective first, second, and third portions, 51–53, of the airflow conduit 32. The first, second, and third annular cavities of the chambers, 41–43, are generally coaxial with their respective first, second, and third portions of the airflow conduit 32. The lengths, L1–L3, of the chambers, 41–43, extend in a direction which is generally parallel to the respective axes of the associated portions, 51–53. In other words, the lengths, L1–L3, are measured in a direction generally parallel to the flow of air through the air conduit 32 as it passes through the associated regions, 51–53, of the air conduit. It should also be noted that the sound, in a preferred embodiment of the present invention, is reflected back toward its source which causes the reflective sound to move in a direction toward the outlet end 34 of the airflow conduit 32. Although alternative embodiments of the present invention can. reflect sound which emanates from the inlet end 30 of the airflow conduit, a preferred embodiment of the present invention is intended to reflect sound which emanates from a screw compressor 74 connected to the outlet end 34 of the airflow conduit.

With particular reference to FIGS. 2 and 3, a preferred embodiment of the present invention comprises three chambers, 41–43. The air flowing through the airflow conduit 32 first passes through the first portion 51 which is associated with the first chamber 41. The first chamber 41 has a length of 88 mm, an inside diameter of the airflow conduit 32 which is 60 mm, and a wall thickness of the airflow conduit which is 3 mm. This results in an outside diameter of the airflow conduit of 66 mm. The inside diameter of the outer tube 40, which defines the first chamber 41, is 89 mm and its outside diameter is 95 mm, which results from the 3 mm wall thickness. The first plurality of holes 61 comprises 32 holes which are arranged in two rows of sixteen holes spaced radially at 22.5°. The length of the hole pattern is 22 mm and the hole pattern is generally centered along the length L1 of the first portion 51. The diameter of each hole is 8 mm and the resulting is volume of the first chamber 41 is approximately 0.246 liters. These calculations are based on an assumed speed of sound of approximately 344 meters per second.

With regard to the second chamber 42, its length L2 is 102 mm. The inside and outside diameters of the second portion 52 are the same as the first portion 51, along with the wall thickness of 3 mm. Similarly, the inside and outside diameters of the outer tube of the second portion 52 are 89 mm and 95 mm which are generally equal to the first portion 51. The wall thickness is 3 mm. In the second region 52, 28 holes are arranged in two rows of 14 spaced radially at 25.7°. The length of the hole pattern is 20 mm and is centered within the second portion 52 of the airflow conduit 32. The second chamber has a volume of 0,285 liters.

The length L3 of the third portion 53 is 105 mm. The inside and outside diameters of the inner tube and outer tube are the same as those for the first and second portions, 51 and 52, of the airflow conduit 32. The third plurality of holes comprises 24 holes arranged in two rows of 12 spaced radially at 30°. The length of the hole pattern is 20 mm and the edge of the hole pattern is located approximately 20 mm from the inside edge of the bottom baffle. The diameter of each of the holes of the third plurality of holes 63 is 8 mm and the third chamber 43 has a volume of 0,294 liters.

Each of the three chambers, 41–43, is particularly configured to result in the reflection of a certain individual range of frequencies of sound. For example, the first chamber 41 and its associated plurality of holes 61 is intended to reflect a range of frequencies of sound of approximately 880 Hertz to 1,650 Hertz. The second chamber 42 is intended to reflect a range of frequencies of sound in a second range which is approximately 770 Hertz to 1,430 Hertz. The third cavity 43, in cooperation with its associated third plurality of holes 63, is designed to reflect a third range of frequencies of sound which is approximately 730 Hertz to 1,320 Hertz. These three ranges of frequencies were chosen in conjunction with a particular application of a particular type of compressor. It should be understood that other ranges chosen for other applications are also within the scope of the present invention.

With particular reference to FIGS. 2 and 3, it can be noted that the plurality of chambers, 41–43, are each arranged in a generally concentric relationship with an associated portion, 51–53, of the airflow conduit 32. This significantly reduces the space required to store the sound attenuating chamber. In addition, the plurality of chambers is arranged axially along the airflow conduit 32 and the relevant length, L1–L3, are disposed axially to minimize the overall size in a radially direction. By using a plurality of chambers, a relatively wide range of frequencies of sound can be reflected with a relatively small structure. In addition, it can be seen that the airflow conduit 32 is unobstructed between the inlet end 30 and the outlet end 34. While it is recognized that the existence of the three pluralities of holes creates a calculable resistance to airflow, that resistance is significantly less than it would be if baffles were inserted into the airflow conduit 32.

Although the present invention has been described in conjunction with its use in combination with a screw compressor and an internal combustion engine, it should be understood that alternative uses are within the scope of the present invention. The present invention can be used in conjunction with a device to which or from which a flow of air is provided and from which a sound is emanating. In an application with a compressor, the airflows from an ambient pressure into the sound attenuator and then to the source of the sound which is a compressor. Other devices which create an airflow can be connected to the present invention. In both cases, the present invention is intended to reflect the sound back to the source of the sound, whether that is in a direction toward the inlet end or the outlet end of the airflow conduit.

Although the present invention has been described with particular specificity and illustrated to show a preferred embodiment, it should be understood that alternative embodiments are also within its scope.

I claim:

1. A sound attenuating system, comprising:

an airflow conduit having an inlet end and an outlet end;

a first chamber disposed proximate a first portion of said airflow conduit, said first chamber having a first length;

a first plurality of holes formed through said first portion of said airflow conduit, said first plurality of holes being in fluid communication between said airflow conduit and said first chamber, wherein said first length and the size of each of said first plurality of holes are selected to be compatible with each other in attenuating a first range of frequencies of sound, which are passing through said airflow conduit;

a second chamber disposed proximate a second portion of said airflow conduit, said second chamber having a second length; and a second plurality of holes formed through said second portion of said airflow conduit, said second plurality of holes being in fluid communication between said airflow conduit and said second chamber, wherein said second length and the size of each of said second plurality of holes are selected to be compatible with each other in attenuating a second range of frequencies of sound, which are passing through said airflow conduit.

2. The system of claim 1, wherein;

said first length and the size of each of said first plurality of holes are selected to be compatible with each other in reflecting said first range of frequencies of sound back toward the source of said first range of frequencies of sound; and said second length and the size of each of said second plurality of holes are selected to be compatible with each other in reflecting said second range of frequencies of sound back toward the source of said second range of frequencies of sound.

3. The system of claim 2, wherein:

said first and second range of frequencies of sound are reflected in a direction toward said outlet end of said airflow conduit.

4. The system of claim 2, further comprising:

a compressor, said outlet end of said airflow conduit is connected in fluid communication with an inlet conduit of said compressor.

5. The attenuator of claim 4, further comprising:

an internal combustion engine having an air intake conduit, said outlet conduit of said compressor being connected in fluid communication with said intake conduit of said internal combustion engine.

6. The device of claim 2, wherein:

said first chamber defines a first annular cavity surrounding said first portion of said airflow conduit, said first annular cavity being generally coaxial with said first portion of said airflow conduit; and said second chamber defines a second annular cavity surrounding said second portion of said airflow conduit, said second annular cavity is generally coaxial with said second portion of said airflow conduit.

7. The device of claim 6, wherein:

said first plurality of holes extends radially through said first portion of said airflow conduit; and said second plurality of holes extends radially through said second portion of said airflow conduit.

8. The device of claim 7, further comprising:

a third chamber disposed proximate a third portion of said airflow conduit, said third chamber having a third length;

a third plurality of holes formed through said third portion of said airflow conduit, said third plurality of holes being in fluid communication between said airflow conduit and said third chamber, wherein said third length and the size of each of said third plurality of holes are selected to be compatible with each other in reflecting a third range of frequencies of sound, which are passing in a direction from said outlet end toward said inlet end of said airflow conduit, back toward said outlet end of said airflow conduit.

9. The device of claim 8, wherein:

said third chamber defines a third annular cavity surrounding said third portion of said airflow conduit; and said third annular cavity is generally coaxial with said third portion of said airflow conduit; and said third plurality of holes extends radially through said third portion of said airflow conduit.

10. The device of claim 9, wherein:

said first length extends in a direction which is generally parallel to a first central axis of said first portion of said airflow conduit.

11. The device of claim 10, wherein:

said second length extends in a direction which is generally parallel to a second central axis of said second portion of said airflow conduit; and said third length extends in a direction which is generally parallel to a third central axis of said third portion of said airflow conduit.

12. A sound attenuating system, comprising:

an airflow conduit having an inlet end and an outlet end;

a first chamber disposed proximate a first portion of said airflow conduit, said first chamber having a first length;

a first plurality of holes formed through said first portion of said airflow conduit, said first plurality of holes being in fluid communication between said airflow conduit and said first chamber, wherein said first length and the size of each of said first plurality of holes are selected to be compatible with each other in reflecting a first range of frequencies of sound, which are passing in a direction from said outlet end toward said inlet end of said airflow conduit, back toward said outlet end of said airflow conduit;

a second chamber disposed proximate a second portion of said airflow conduit, said second chamber having a second length; and a second plurality of holes formed through said second portion of said airflow conduit, said second plurality of holes being in fluid communication between said airflow conduit and said second chamber, wherein said second length and the size of each of said second plurality of holes are selected to be compatible with each other in reflecting a second range of frequencies of sound, which are passing in a direction from said outlet end toward said inlet end of said airflow conduit, back toward said outlet end of said airflow conduit.

13. The system of claim 12, further comprising:

a screw compressor having an inlet conduit and an outlet conduit, said outlet end of said airflow conduit being connected in fluid communication with said inlet conduit of said screw compressor.

14. The system of claim 13, further comprising:

an internal combustion engine having an air intake conduit, said outlet conduit of said screw compressor being connected in fluid communication with said intake conduit of said internal combustion engine.

15. The device of claim 14, wherein:

said first chamber defines a first annular cavity surrounding said first portion of said airflow conduit;

said second chamber defines a second annular cavity surrounding said second portion of said airflow conduit;

said first annular cavity is generally coaxial with said first portion of said airflow conduit;

said second annular cavity is generally coaxial with said second portion of said airflow conduit;

said first plurality of holes extends radially through said first portion of said airflow conduit; and said second plurality of holes extends radially through said second portion of said airflow conduit.

16. The device of claim 15, further comprising:

a third chamber disposed proximate a third portion of said airflow conduit, said third chamber having a third length;

a third plurality of holes formed through said third portion of said airflow conduit, said third plurality of holes being in fluid communication between said airflow conduit and said third chamber, wherein said third length and the size of each of said third plurality of holes are selected to be compatible with each other in reflecting a third range of frequencies of sound, which are passing in a direction from said outlet end toward said inlet end of said airflow conduit, back toward said outlet end of said airflow conduit.

17. The device of claim 16, wherein:

said third chamber defines a third annular cavity surrounding said third portion of said airflow conduit; and said third annular cavity is generally coaxial with said third portion of said airflow conduit; and said third plurality of holes extends radially through said third portion of said airflow conduit.

18. The device of claim 16, wherein:

said first length extends in a direction which is generally parallel to a first central axis of said first portion of said airflow conduit;

said second length extends in a direction which is generally parallel to a second central axis of said second portion of said airflow conduit; and said third length extends in a direction which is generally parallel to a third central axis of said third portion of said airflow conduit.

19. A sound attenuating system, comprising:

an internal combustion engine having an air intake conduit;

a compressor having an inlet conduit and an outlet conduit, said outlet conduit being connected in fluid communication with said intake conduit of said internal combustion engine;

an airflow conduit having an inlet end and an outlet end, said outlet end being connected in fluid communication with said inlet conduit of said compressor;

a first chamber disposed proximate a first portion of said airflow conduit, said first chamber having a first length;

a first plurality of holes formed through said first portion of said airflow conduit, said first plurality of holes being in fluid communication between said airflow conduit and said first chamber, wherein said first length and the size of each of said first plurality of holes are selected to be compatible with each other in reflecting a first range of frequencies of sound, which are passing in a direction from said outlet end toward said inlet end of said airflow conduit, back toward said outlet end of said airflow conduit;

a second chamber disposed proximate a second portion of said airflow conduit, said second chamber having a second length; and a second plurality of holes formed through said second portion of said airflow conduit, said second plurality of holes being in fluid communication between said airflow conduit and said second chamber, wherein said second length and the size of each of said second plurality of holes are selected to be compatible with each other in reflecting a second range of frequencies of sound, which are passing in a direction from said outlet end toward said inlet end of said airflow conduit, back toward said outlet end of said airflow conduit said first chamber defining a first annular cavity surrounding said first portion of said airflow conduit, said second chamber defining a second annular cavity surrounding said second portion of said airflow conduit, said first annular cavity being generally coaxial with said first portion of said airflow conduit, said second annular cavity being generally coaxial with said second portion of said airflow conduit, said first plurality of holes extending radially through said first portion of said airflow conduit, said second plurality of holes extending radially through said second portion of said airflow conduit.

20. The device of claim 19, further comprising:

a third chamber disposed proximate a third portion of said airflow conduit, said third chamber having a third length;

a third plurality of holes formed through said third portion of said airflow conduit, said third plurality of holes being in fluid communication between said airflow conduit and said third chamber, wherein said third length and the size of each of said third plurality of holes are selected to be compatible with each other in reflecting a third range of frequencies of sound, which are passing in a direction from said outlet end toward said inlet end of said airflow conduit, back toward said outlet end of said airflow conduit, said third chamber defining a third annular cavity surrounding said third portion of said airflow conduit, said third annular cavity being generally coaxial with said third portion of said airflow conduit, said third plurality of holes extending radially through said third portion of said airflow conduit.

* * * * *